US006487763B1

(12) United States Patent
Reichert

(10) Patent No.: US 6,487,763 B1
(45) Date of Patent: Dec. 3, 2002

(54) KIT FOR ASSEMBLY OF A DECORATIVE ITEM

(75) Inventor: Linda K. Reichert, Marion, IL (US)

(73) Assignee: Associated Technology, Marion, IL (US)

( * ) Notice: Subject to any disclaimer, the term of this patent is extended or adjusted under 35 U.S.C. 154(b) by 7 days.

(21) Appl. No.: 09/909,205

(22) Filed: Jul. 19, 2001

(51) Int. Cl.[7] ..... B25B 27/14

(52) U.S. Cl. ..... 29/281.5; 29/282; 269/47; 269/54.5

(58) Field of Search ..... 29/282, 280, 281.5, 29/283, 235; 269/54.5, 47

(56) References Cited

U.S. PATENT DOCUMENTS 2,372,779 A * 4/1945 Herman et al. ..... 269/54.5
3,099,876 A * 8/1963 Lawless ..... 29/282
3,868,757 A * 3/1975 Abbo ..... 269/54.5
4,303,233 A * 12/1981 Meyer, III ..... 269/54.5
6,131,895 A * 10/2000 Sorel et al. ..... 269/54.5

* cited by examiner

*Primary Examiner*—Robert C. Watson
(74) *Attorney, Agent, or Firm*—Pitts & Brittian, P.C.

(57) ABSTRACT

The present invention comprises a kit useful for the assembly of a decorative item, or art object, such as a decorative cover for a light bulb. In one embodiment, the kit of the present invention comprises a base adapted to rest on a supporting surface, the base including a receptacle defined therein and opening outwardly of one surface of the base, a spear having a proximal end adapted to be releasably received within the receptacle, the spear including a tapered distal end, and having a portion of the length thereof between its proximal end and its tapered distal end of a reduced cross-sectional area, whereby there is defined a circumferential shoulder at the juncture of the reduced cross-sectional area and the tapered distal end of the spear, a ferrule-type fitting adapted to be received in encircling relationship to the reduced cross-sectional area of the spear and adapted to slide onto the proximal end of the spear to a location adjacent the circumferential shoulder, whereby the fitting is received by and substantially fully occupies the reduced cross-sectional area of the spear, and a fastener having a central opening therethrough and adapted to fixedly engage the outer circumference of the fitting.

7 Claims, 3 Drawing Sheets

KIT FOR ASSEMBLY OF A DECORATIVE ITEM

TECHNICAL FIELD OF INVENTION

This invention relates to kits for the assembly of decorative items such as covers for light bulbs employing such art objects as artificial flower blossoms.

BACKGROUND OF INVENTION

Artificial flower blossoms, and other art objects, are known in the art for many uses, including use as covers for light bulbs, such as the well-known strings of light bulbs used to decorate Christmas trees, perimeters of porches or patios, and the like. The purchaser of such finished, ready-to-use, flower blossoms are at the mercy of the manufacturer as regards the choice of which flower blossom is chosen as the light bulb cover, as well as the purchase price of the bulb cover.

Artificial flower blossoms are also commonly used in the aggregate to define floral bouquets, and the like. After a period of time, such bouquets tend to lose their allure, but heretofore there has been no ready means available to convert the blossoms of such bouquets to another use.

SUMMARY OF INVENTION

The present invention comprises a kit useful for the assembly of a decorative item, or art object, such as a decorative cover for a light bulb. In one embodiment, the kit of the present invention comprises a base adapted to rest on a supporting surface, the base including a,receptacle defined therein and opening outwardly of one surface of the base, a spear having a proximal end adapted to be releasably received within the receptacle, the spear including a tapered distal end, and having a portion of the length thereof between its proximal end and its tapered distal end of a reduced cross-sectional area, whereby there is defined a circumferential shoulder at the juncture of the reduced cross-sectional area and the tapered distal end of the spear, a ferrule-type fitting including first and second ends and adapted to be received in encircling relationship to the reduced cross-sectional area of the spear and adapted to slide onto the proximal end of the spear to a location adjacent the circumferential shoulder, the fitting having an outer circumference which registers with the outer circumference of the shoulder when the fitting is disposed on the spear to define a transition between the distal tapered end and the reduced cross-sectional area of said spear, the first end of the fitting including a circumferential shoulder which is adapted to engage the surface of the base, whereby the fitting is received by and substantially fully occupies the reduced cross-sectional area of the spear, and a fastener having a central opening therethrough and adapted to fixedly engage the outer circumference of the fitting.

In use, a fitting is fitted onto the proximal end of a spear and the proximal end of the spear is disposed within the receptacle defined in the base. The base preferably is of substantial bulk and weight as to physically support the spear in an upright position. Thereafter, an artificial flower blossom or other art object having an opening therethrough or which is pierceable by the spear is threaded onto the spear and urged toward the base until the-blossom is fully in encircling relationship to the fitting. Thereupon, a fastener is frictionally threaded onto the distal end of the spear and urged along the length of the spear and onto the fitting adjacent the blossom. Through frictional engagement between the fastener and the outer circumference of the fitting, the blossom is captured between the shoulder on the fitting and the fastener. Thereupon, the spear is withdrawn from the receptacle in the base and from the assembled blossom, fitting and fastener. The inner bore of the fitting is chosen to frictionally-receive therein the outer circumference of a common light bulb of the type commonly employed in strings of lights and which includes at least a portion of the body, e.g., base, thereof of a straight cylindrical geometry suitable to be frictionally received within the fitting.

DETAILED DESCRIPTION OF INVENTION

Figure 1:
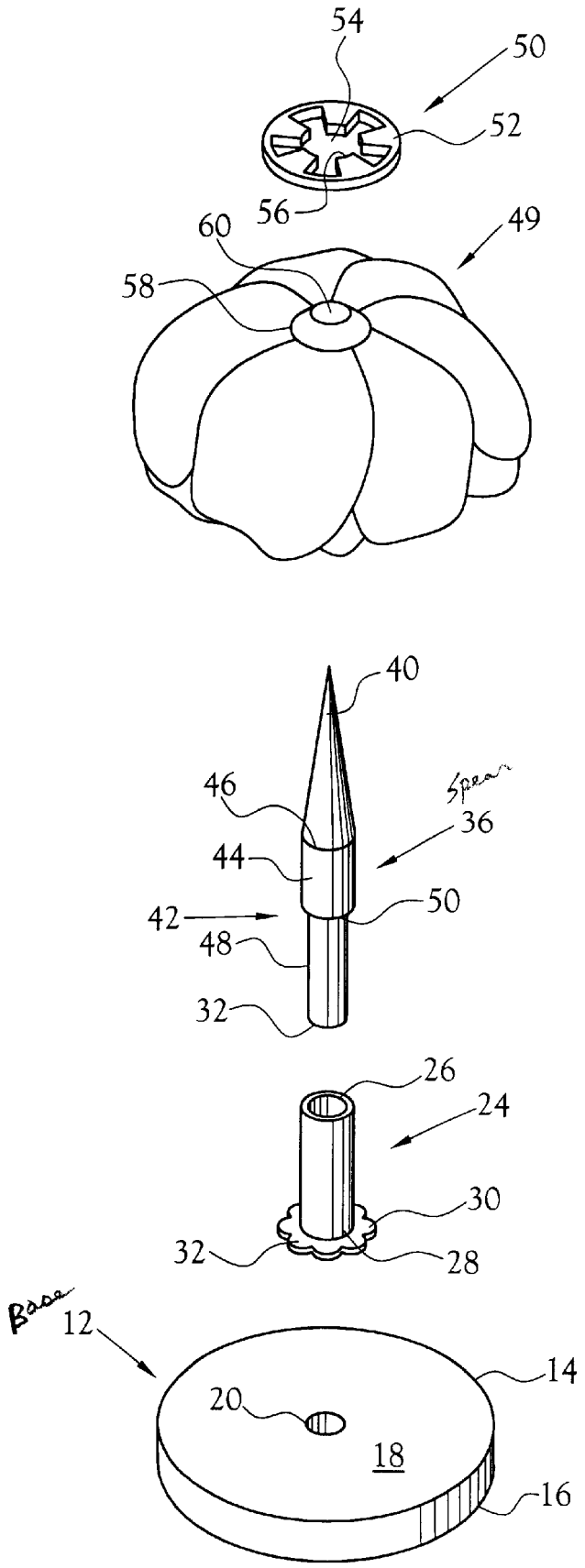
FIG. 1 is an exploded representation of a kit embodying various features of the invention.

Referring to FIG. 1, the depicted embodiment of the kit of the present invention includes a base 12, which in the depicted embodiment takes the geometry of a disc 14 having a back surface 16 and a front surface 18. The back surface 16 of the base is flat so as to provide for engagement of the base with a horizontal supporting surface, such as a table top (not shown). The front surface 18 of the base is provided with a receptacle 20 which opens outwardly from the front surface. In the depicted embodiment, this receptacle is of a hollow cylindrical depression.

As further depicted in FIG. 1, the depicted kit includes a ferrule-type fitting 24, which in the depicted embodiment is of a straight hollow cylindrical geometry having first and second ends 26,28, respectively, and having a circumferential shoulder 30 integrally formed with, and extending radially from, the second end 28. This depicted shoulder 30 includes a scalloped outer margin 32 for decorative purposes.

The depicted kit further includes a spear 36 having a proximal end 38, a tapered distal end 40 and a body portion 42 extending between the proximal and distal ends of the spear. The body portion of the depicted spear is divided into two portions, a first portion 44 being of a straight cylindrical geometry which extends from the demarcation 46 between the beginning of the taper of the distal end of the spear and the beginning of a reduced diameter second body portion 48. By reason of their different diameters, the juncture between the first and second body portions defines a circumferential shoulder 50.

As depicted in FIG. 1, the internal diameter of the fitting 24 is chosen to permit the fitting to receive therethrough the second body portion 48 of the spear, while precluding the complete passage of the spear through the fitting by reason of the first end 26 of the fitting engaging the circumferential shoulder 50 of the spear. Further, the outer diameter of the fitting 24 is chosen to be not greater than the outer diameter of the first body portion 44 of the spear so that there can be a substantially seamless transition from the outer diameter of the first body portion 44 to the outer diameter of the fitting for purposes which will appear hereinafter. Further, it will be noted that the presence of the circumferential shoulder 30 of the fitting precludes passage of the fitting into the receptacle of the base 12. This circumferential shoulder further serves as a stop against the movement of a flower blossom 49, for example, off the second end 28 of the fitting when the fitting is removed from the spear.

The depicted kit further includes a fastener 50 which in the depicted embodiment takes the form of a flat ring washer 52 having an open center 54 into which there radially project a plurality of bendable members 56. As will be described hereinafter, this fastener is sized to be urged onto the spear, thence onto the outer circumference of the fitting. This action deflects the bendable members 56 sufficiently to permit the passage of the fastener onto the fitting whereupon the distal ends of the members 56 frictionally engage the outer circumference of the fitting to preclude ready removal of the fastener from the fitting (see FIG. 3). By this means, an artificial flower blossom 49, for example, becomes captured between the circumferential shoulder 30 and the fastener 50 and remains so captured after the assembled fitting and fastener (and blossom) are removed from the spear.

Optionally, the kit of the present invention may also include an artificial flower blossom 49, or other art object, which desirably is to be secured to the fitting 24. The depicted blossom 49 includes a central portion 58 which either is provided with an opening 60 or which is pierceable by the distal end 40 of the spear, such that the blossom may be threaded onto the distal end of the spear, moved along the length of the spear and thence onto the fitting 24, where the blossom may be anchored by the fastener 50.

Figure 3:
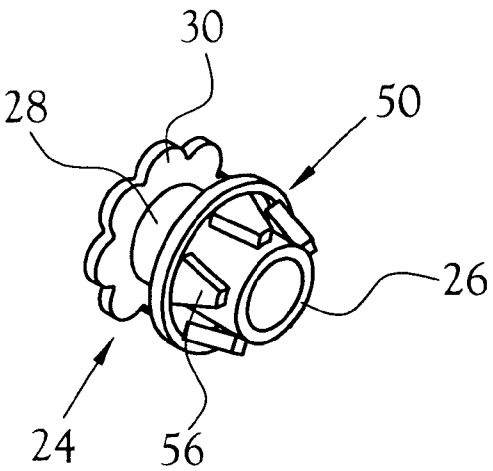
FIG. 3 is a representation of a fitting and a fastener as assembled, absent an artificial blossom captured therebetween.

With reference to FIG. 3, there is depicted an assembled fitting 24 and a fastener 50 and showing the frictional engagement of the bendable members 56 of the fastener with the outer circumferential surface of the fitting.

Figure 4:
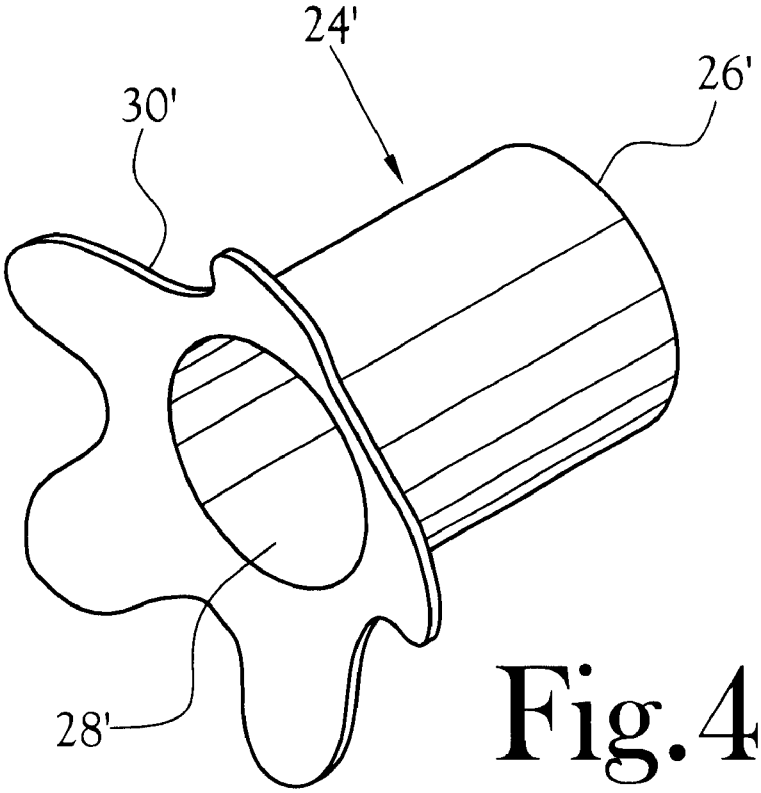
FIG. 4 is a representation of a further embodiment of a fitting as employed in the kit of the present invention.
Figure 5:
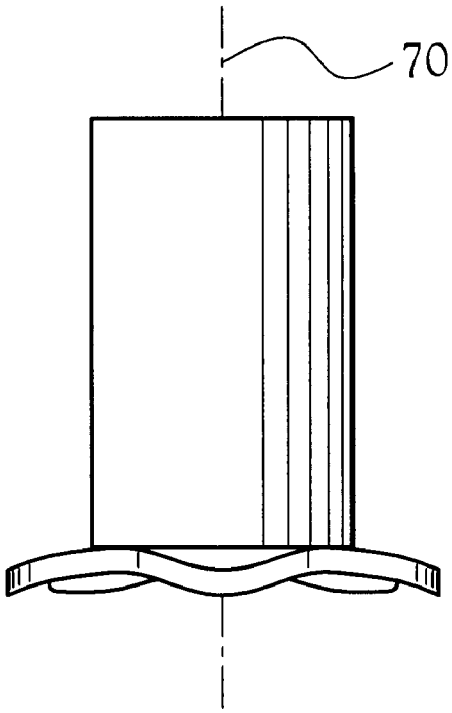
FIG. 5 is a side elevation view of the fitting depicted in FIG. 4.

FIGS. 4 and 5 depict an alternative embodiment of a suitable fitting 24' in which the circumferential shoulder 30' of the fitting is flared (i.e., non-flat), hence is disposed non-perpendicular to the longitudinal dimension 70 of the fitting, hence nonparallel to the cross-section of the fitting. Rather, in the embodiment of FIG. 4, the circumferential shoulder flares outwardly from the second end 28' of the fitting, thereby permitting a flower blossom to be oriented in a draping fashion from the second end of the fitting, thereby somewhat camouflaging the shoulder.

In use of the present kit, the base is positioned on a horizontal supporting surface with its outwardly opening receptacle facing upwardly. A fitting is slid into encircling relationship to the reduced diameter body portion of the spear, the circumferential shoulder of the fitting being disposed toward the proximal end of the spear. Thereupon, the proximal end of the spear is placed within the receptacle whereupon the spear, with the fitting in place thereon, is self-supporting in a substantially vertical position.

Once the spear is mounted within the base, an artificial flower blossom which either has a through opening generally centrally thereof, or which is pierceable by the pointed sharp tip of the tapered distal end of the spear, is threaded (fed or pushed) onto the spear, along the length of the spear, thence onto the outer circumference of the fitting. Thereupon, a fastener is threaded (fed or pushed) onto the distal end of the spear, along the length of the spear, thence onto the outer circumference of the fitting where the bendable members of the fastener frictionally engage the outer circumference of the fitting to thereby capture the flower blossom between the circumferential shoulder of the fitting and the frictionally anchored fastener.

Figure 2:
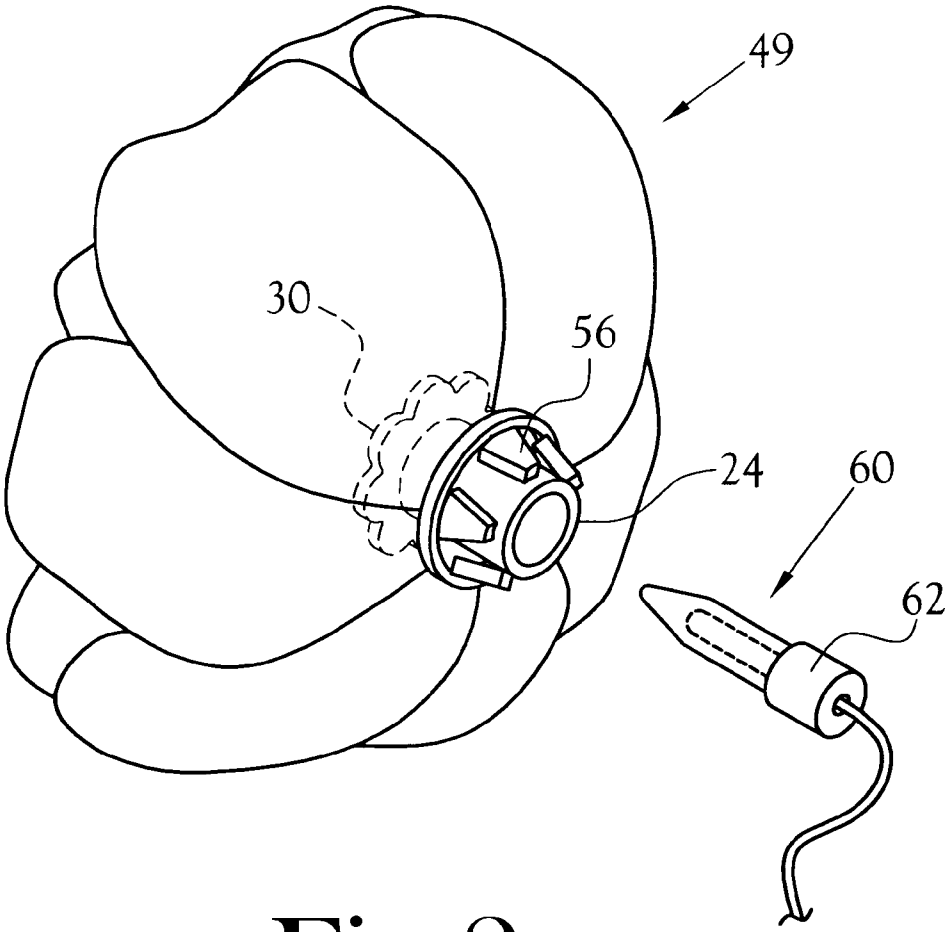
FIG. 2 is an exploded representation of an artificial flower blossom assembled employing the kit of the present invention and depicting a light bulb to be received within the fitting of the assembly.

Once the flower blossom and the fastener are assembled with the fitting, the spear may be withdrawn from the receptacle in the base and from the fitting. FIG. 2 depicts a flower blossom 49 as so captured between the circumferential shoulder 30 of the fitting and the fastener 50. It is to be noted that the inner diameter of the fitting is chosen to receive therein a light bulb 60 having at least a portion of the body thereof formed in a straight cylindrical geometry. In a preferred embodiment, the light bulb includes a cylindrical base 62 which is frictionally engageable with the inner diameter of the fitting to thereby retain the light bulb within the fitting, hence retain the blossom as a decorative cover for the light bulb. In this embodiment, at least a portion of the light bulb may protrude from that end of the fitting which includes the circumferential shoulder and thereby enhance the attractiveness of the assembly when the light bulb is powered on.

Whereas the present invention has been described in terms of using an artificial flower blossom, it will be recognized that other geometrical objects may be employed in lieu of the flower blossom. For example, an open ended globe object may be employed, as may be any one of a very large variety of objects. Moreover, the kit of the present invention may be employed to assemble decorative items other than light bulb covers.

Further, whereas the fastener depicted herein is in the form of a friction washer, a person skilled in the art will recognize that various other fastener types will serve suitably in the present kit. For example, an adhesive fastener may be fashioned to aid in capture of the impaled object on the fitting. In a preferred embodiment, the fastener is formed of a flexible plastic material.

In a preferred embodiment, the base and spear of the present invention are formed of a metal to provide rigidity. Also preferably, the fitting is formed of a polymeric material which is at least semi-rigid.

Artificial flower blossoms, such as the common "silk" flower blossoms, serve suitably in the present invention. As noted hereinabove, the flower blossom optionally may be included in the kit. It will be recognized, however, that a kit which does not include a flower blossom, or the like, may be used to assemble a light bulb cover using "left-over" flower blossoms from a used bouquet which has otherwise lost its allure, thereby recycling such bouquet after a fashion.

What is claimed:

1. A kit for the assembly of a decorative item comprising, a base adapted to rest on a supporting surface, said base including a receptacle defined therein and opening outwardly of that surface of said base opposite the supporting surface, a spear having a proximal end adapted to be releasably received within said receptacle, said spear including a tapered distal end, and having a portion of the length thereof between said proximal end and said tapered distal end of a reduced cross-sectional area, whereby there is defined a circumferential shoulder at the juncture of said reduced cross-sectional area and said tapered distal end of said spear, a ferrule-type fitting including first and second ends and adapted to be received in encircling relationship to said reduced cross-sectional area of said spear and adapted to slide onto said proximal end of said spear to a location adjacent said circumferential shoulder, said fitting having an outer circumference which registers with the outer circumference of said shoulder when said fitting is disposed on said spear to define a substantially seamless transition between said distal tapered end and said reduced cross-sectional area of said spear, said second end of said fitting including a circumferential shoulder, said shoulder being adapted to engage said opposite surface of said base, whereby the length of said fitting substantially fully occupies said reduced cross-sectional area of said spear, and, a fastener adapted to fixedly engage said outer circumference of said fitting.

2. The kit of claim 1 and including a decorative item having a central portion having either a central opening therethrough or being pierceable by said distal end of said spear for the passage of said central portion along the length of said spear and onto said fitting and in position to be captured between said circumferential shoulder of said fitting and said fastener.

3. The kit of claim 1 wherein said base comprises a substantially flat plate having at least one surface thereof adapted to engage a supporting surface and an opposite surface thereof having a receptacle defined therein for the receipt of said proximal end of said spear.

4. The kit of claim 1 wherein the spatial separation distance between said circumferential shoulder of said spear and said opposite surface of said base is essentially equal to the length of said fitting whereby said fitting substantially fully occupies said spatial separation distance when said fitting is disposed in encircling relationship to said spear and said proximal end of said spear is disposed within said receptacle defined in said base.

5. The kit of claim 1 wherein said fastener comprises a disc having a central opening and a plurality of flexible members extending radially inwardly of said central opening in position to frictionally engage said outer circumference of said fitting.

6. The kit of claim 1 wherein said circumferential shoulder of said fitting includes a scalloped outer circumferential margin.

7. The kit of claim 6 wherein said scalloped outer circumferential margin is non-parallel to the cross-section of said fitting.

* * * * *